US009010266B2

(12) United States Patent
Rowiński et al.

(10) Patent No.: US 9,010,266 B2
(45) Date of Patent: Apr. 21, 2015

(54) UNDERWATER-ABOVE WATER ACCOMMODATION FOR RESIDENTIAL PURPOSES

(75) Inventors: Lech Adam Rowiński, Stanislawowo (PL); Jacek Ireneusz Zdrojewski, Gdynia (PL)

(73) Assignee: Deep Ocean Technology SP. Z.O.O., Gdynia (PL)

( * ) Notice: Subject to any disclaimer, the term of this patent is extended or adjusted under 35 U.S.C. 154(b) by 134 days.

(21) Appl. No.: 13/820,532

(22) PCT Filed: Sep. 2, 2011

(86) PCT No.: PCT/PL2011/050034

§ 371 (c)(1), (2), (4) Date: Mar. 4, 2013

(87) PCT Pub. No.: WO2012/036574

PCT Pub. Date: Mar. 22, 2012

(65) Prior Publication Data

US 2013/0164087 A1 Jun. 27, 2013

(30) Foreign Application Priority Data

Sep. 17, 2010 (PL) ..... 392432

(51) Int. Cl.
*E02B 17/00* (2006.01)
*B63B 35/44* (2006.01)

(Continued)

(52) U.S. Cl.
CPC ..... *E02B 17/00* (2013.01); *B63B 35/44* (2013.01); *B63C 11/36* (2013.01); *B63C 11/38* (2013.01); *E02B 17/0818* (2013.01); *E02B 17/0836* (2013.01); *E02B 17/0872* (2013.01)

(58) Field of Classification Search
CPC ..... B63B 35/44; B63C 11/00; B63C 11/36; E02B 17/00; E02D 27/00; E04H 9/00
USPC ..... 114/264, 265, 267; 405/194, 196, 203
See application file for complete search history.

(56) References Cited

U.S. PATENT DOCUMENTS 3,680,515 A 8/1972 Yoneda et al.

(Continued)

FOREIGN PATENT DOCUMENTS

CA 2 342 378 A1 9/2002

(Continued)

*Primary Examiner* — Lars A Olson
(74) *Attorney, Agent, or Firm* — Ladas & Parry LLP

(57) ABSTRACT

An underwater-above water accommodation is adapted for human occupancy under water, above or on the surface of water and comprises an underwater accommodation (1) and above water accommodation (2) slidably mounted on preferably three, vertical legs (3, 4, 5). At least one vertical shaft (23) is fixed to the underwater accommodation (1), contains a lift (26) and stairs (28) inside and is slidably mounted in a sleeve (24) fixed to the above water accommodation (2). The underwater accommodation (1) has a pressure shell (12), in the lower part of which a first ballast tank (29) is located; the above water accommodation (2) has a structure (13), in the lower part of which a second ballast tank (30) is attached. At the sliding joint with the vertical legs (3, 4, 5) the underwater accommodation (1) has built-in sliding joint bushings (9, 10, 11) tightly linked to the pressure shell (12). At the sliding joint with vertical legs (3, 4, 5) the structure (13) is fixed to the sliding joint bushings (14, 15, 16). At least one rack (31) is attached to each vertical leg (3, 4, 5) and cooperates with a toothed wheel (32) being fixed to the structure (13) and driven by a drive unit (33); a drive wheel (49) is attached to the structure (13) and it is connected to a brake drum (50) and driven by a drive unit (52) via a disengagable clutch (51); a chain or a rope (44) is wound on the drive wheel (49) and the brake drum (50) is in contact with a brake pad (54), which is pressed against the brake drum (50) by a pad actuator (56), by means of a actuator lever (55).

6 Claims, 7 Drawing Sheets

(51) Int. Cl.

| | |
|---|---|
| ***B63C 11/36*** | (2006.01) |
| ***B63C 11/38*** | (2006.01) |
| ***E02B 17/08*** | (2006.01) |

(56) References Cited

U.S. PATENT DOCUMENTS

| | | | | |
|---|---|---|---|---|
| 3,708,991 | A * | 1/1973 | Barkley | 405/194 |
| 4,565,149 | A * | 1/1986 | Clasky et al. | 114/264 |
| 6,073,573 | A * | 6/2000 | Gruber | 114/264 |
| 8,011,159 | B1 * | 9/2011 | Saebi | 114/264 |

FOREIGN PATENT DOCUMENTS

| | | | |
|---|---|---|---|
| DE | 24 03 201 | A1 | 7/1974 |
| WO | 2005/085534 | A1 | 9/2005 |

* cited by examiner

UNDERWATER-ABOVE WATER ACCOMMODATION FOR RESIDENTIAL PURPOSES

TECHNICAL FIELD

The present invention relates to an underwater-above water accommodation for residential purposes, adapted for human occupancy in a compartment located under the water and in a compartment located above or on the surface of the water.

TECHNICAL BACKGROUND

A housing mechanism, known from the description of the Polish utility model PL-113571, consists of residential and utility accommodations covered with a roof, and the whole accommodation mechanism is founded on a raft.

It is known from the Polish patent application No. PL-341881 a water taxi, which consists of two boats completely filled with a light non-absorbable substance and covered with a deck joined with platforms, whereas an additional deck with seats is mounted on the landing placed on the platforms.

It is known from the patent application No. PL-370506 a sea platform with a single hull including several bows, each having a flat keel. A transverse stern closure is attached to these bows by means of an inclined floating surface, and two external closures form an air chamber.

DISCLOSURE OF THE INVENTION

The essence of the invention is that the underwater accommodation and the above water accommodation are slidably joined to preferably three, vertical legs forming a sliding joint between each of the legs and the underwater accommodation; the underwater accommodation is placed under water and at least one vertical shaft is fixed to it; the at least one vertical shaft contains a lift and stairs and it is slidably mounted in the above water accommodation in a sleeve fixed to the above water accommodation; the underwater accommodation has a pressure shell, in the lower part of which a first ballast tank is located, the above water accommodation has a structure, in the lower part of which a second ballast tank is attached; at the sliding joint with the vertical legs the underwater accommodation has built-in sliding joint bushings linked to the pressure shell of the underwater accommodation by a leak-proof joint; at the sliding joint with vertical legs the structure of the above water accommodation is fixed to the sliding joint bushings, at least one rack is attached to each vertical leg and cooperates with a toothed wheel being fixed to the structure of the above water accommodation and driven by a drive unit; a drive wheel is attached to the structure of the above water accommodation and it is connected to a brake drum and driven by a drive unit via a disengagable clutch; a chain or a rope is wound on the drive wheel and the brake drum is in contact with a brake pad, which is pressed against the brake drum by a pad actuator, by means of a actuator lever.

Preferably, the sliding joint bushings, in which the legs are located, are attached to the pressure shell of the underwater accommodation on the outside of the shell, and at the sliding joint of the above water accommodation with vertical legs the structure of the above water accommodation is fixed to the sliding joint bushings.

Preferably, each vertical leg is provided with at least one vertical row of holes, which holes alternately receive pins, slidably mounted in guiding elements; the guiding element is movable by a guiding element actuator and together with the guiding element actuator is fixed to the structure of the above water accommodation, whereas the other guiding element is movable by a guiding element actuator and together with the pin and the guiding element actuator is fixed to a base, which is slidable vertically by means of a base actuator.

Preferably, the underwater-above water accommodation comprises a chain or a rope being attached to the lower part of the shell of the underwater accommodation at each vertical leg at point, wherein the chain or the rope passes through a roller and a locking device which has jaws clamped by a jaw actuator and a screw with a hand drive.

Preferably, the underwater-above water accommodation comprises a chain or a rope which passes through a roller and a locking device and is attached to a hydraulic actuator powered by a pipe, in which a cut off valve is installed.

The advantage of the invention is that the aquatic environment can be used for rest and recreation purposes, and the people staying in the underwater accommodation or the above water accommodation can observe this environment, whereas the construction of the accommodation ensures safety for the people staying in the underwater accommodation due to its capability of rapid surfacing.

DESCRIPTION OF DRAWINGS

The subject of the invention is presented as the exemplary embodiments on the drawings, in which.

DETAILED DESCRIPTION OF THE INVENTION

Figure 1:
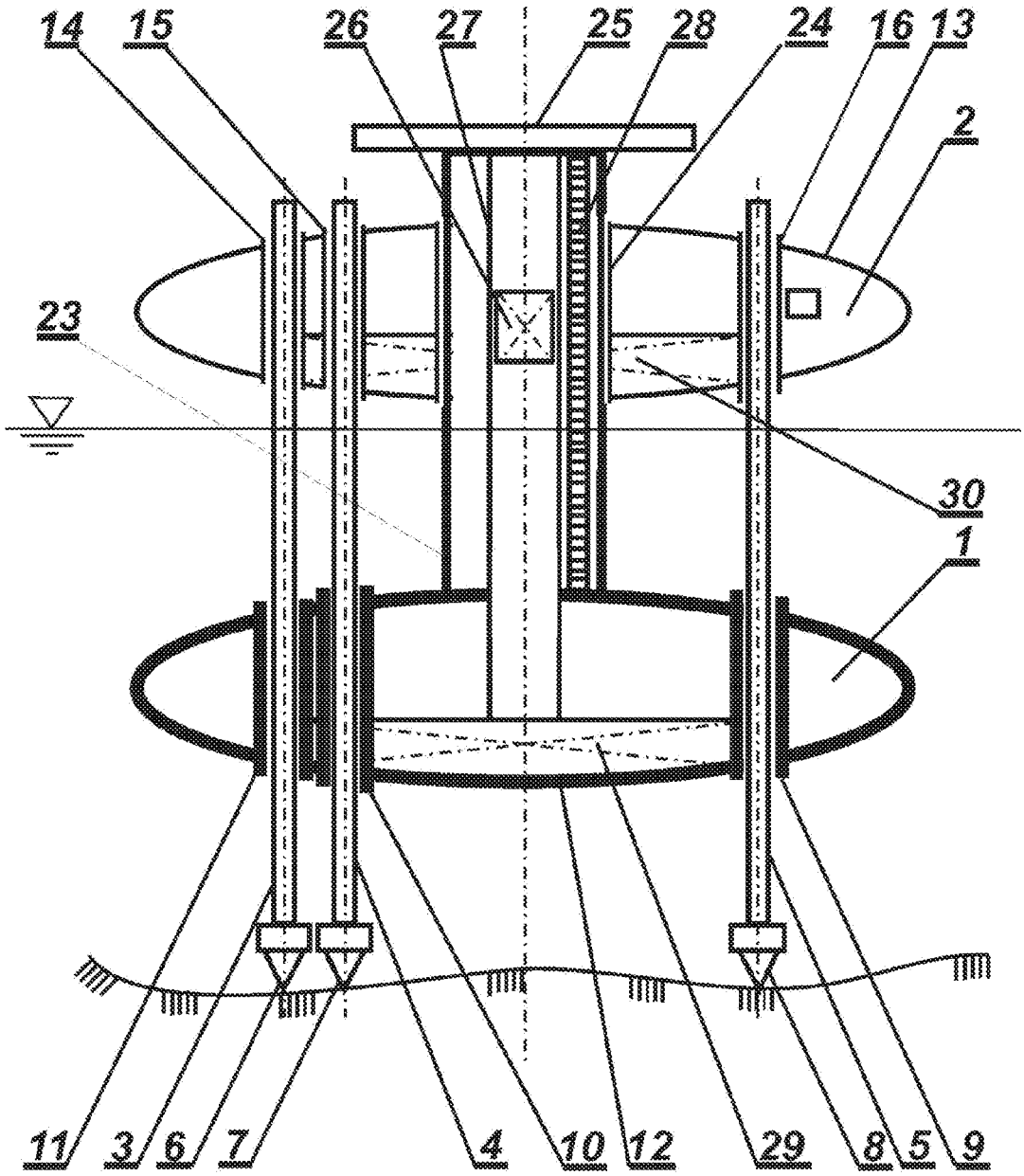
FIG. 1 shows a schematic view of an underwater-above water accommodation.

According to FIG. 1, an underwater-above water accommodation comprises an underwater accommodation 1, which is submerged under the water surface, and above water accommodation 2, located above the water surface. The above water accommodation 2 can be lowered onto the water surface. Both the underwater accommodation 1 and the above water accommodation 2 are slidably joined to three vertical legs 3,4,5, which pass through the structures of the underwater accommodation 1 and above water accommodation 2 and which are provided, at their lower ends, with feet 6,7,8, resting on the bottom of the water region in the place of use of the object.

At the sliding joint with vertical legs 3,4,5, the underwater accommodation 1 has sliding joint bushings 9,10,11, connected to the pressure shell 12 of the underwater accommodation 1 by a leak-proof joint, whereas at the sliding joint with vertical legs 3,4,5, the structure 13 of the above water accommodation 2 is fixed to the sliding joint bushings 14,15,16.

At the top of the underwater accommodation 1, fixed to the shell 12 is a vertical shaft 23, slidably mounted in a sleeve 24 which is fixed to the structure 13 of the above water accommodation 2. The vertical shaft 23 is provided with a platform 25 at its upper part, a lift 26 mounted within guides 27 and stairs 28.

In the lower part of the shell 12 of the underwater accommodation 1, there is located a ballast tank 29 filled with water whereas in the lower part of the above water accommodation 2 there is another ballast tank 30 filled with water and fixed to the structure 13.

Figure 3:
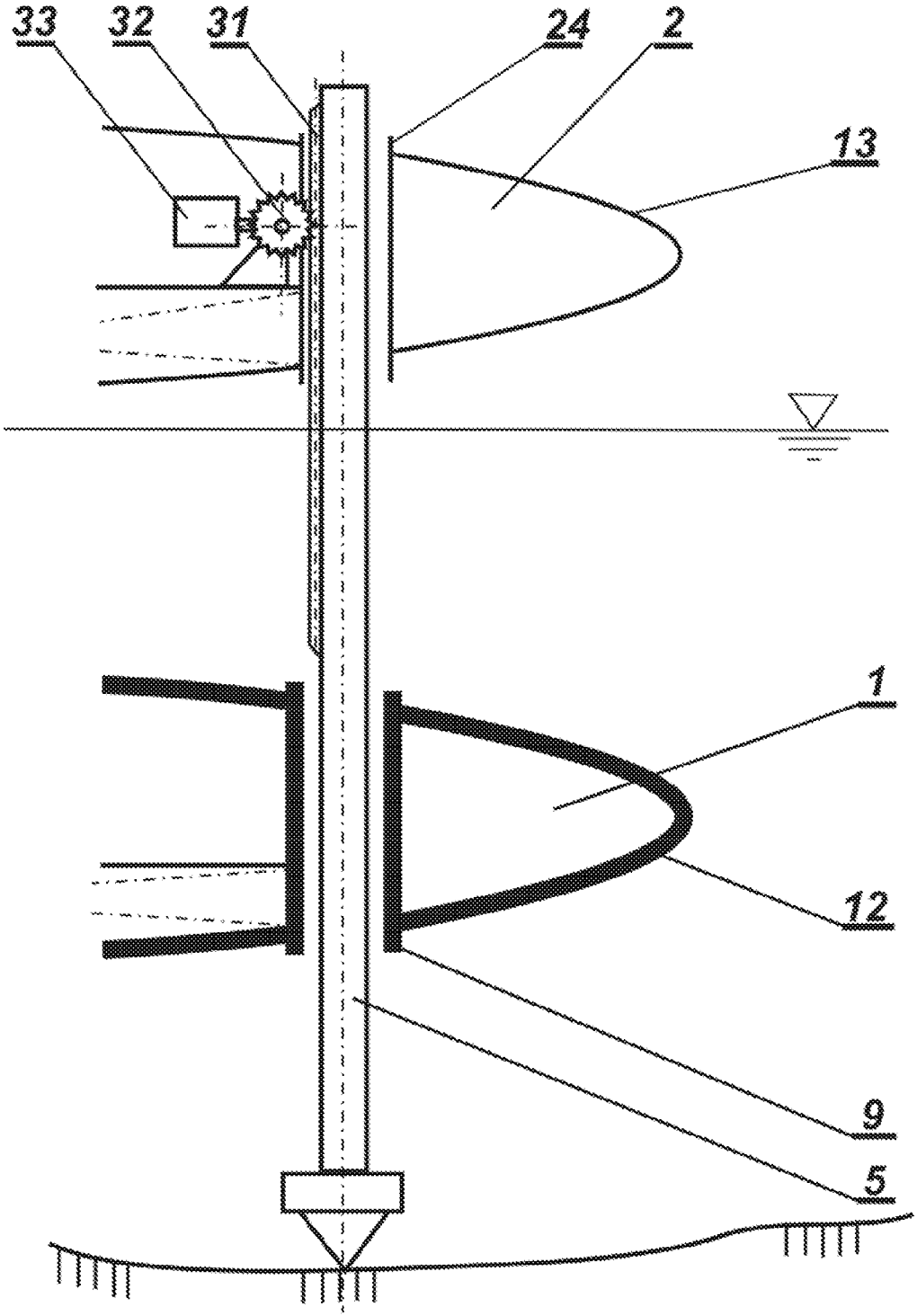
FIG. 3 shows the first embodiment of the structure of an assembly for moving the legs with respect to the structure of the above water accommodation.

In the first embodiment of the structure of the assembly for moving the legs 3,4,5 with respect to the structure 13 of the above water accommodation 2 according to FIG. 3, to each vertical leg 3,4,5 there is secured a rack 31 cooperating with a toothed wheel 32 driven by a drive unit 33 and attached to the structure 13 of the above water accommodation 2; the drive units 33 raise and lower the above water accommodation 2 on the legs 3,4,5 by operation of the toothed wheels 32 engaged with the racks 31 attached to each of the vertical legs 3,4,5.

Figure 6:
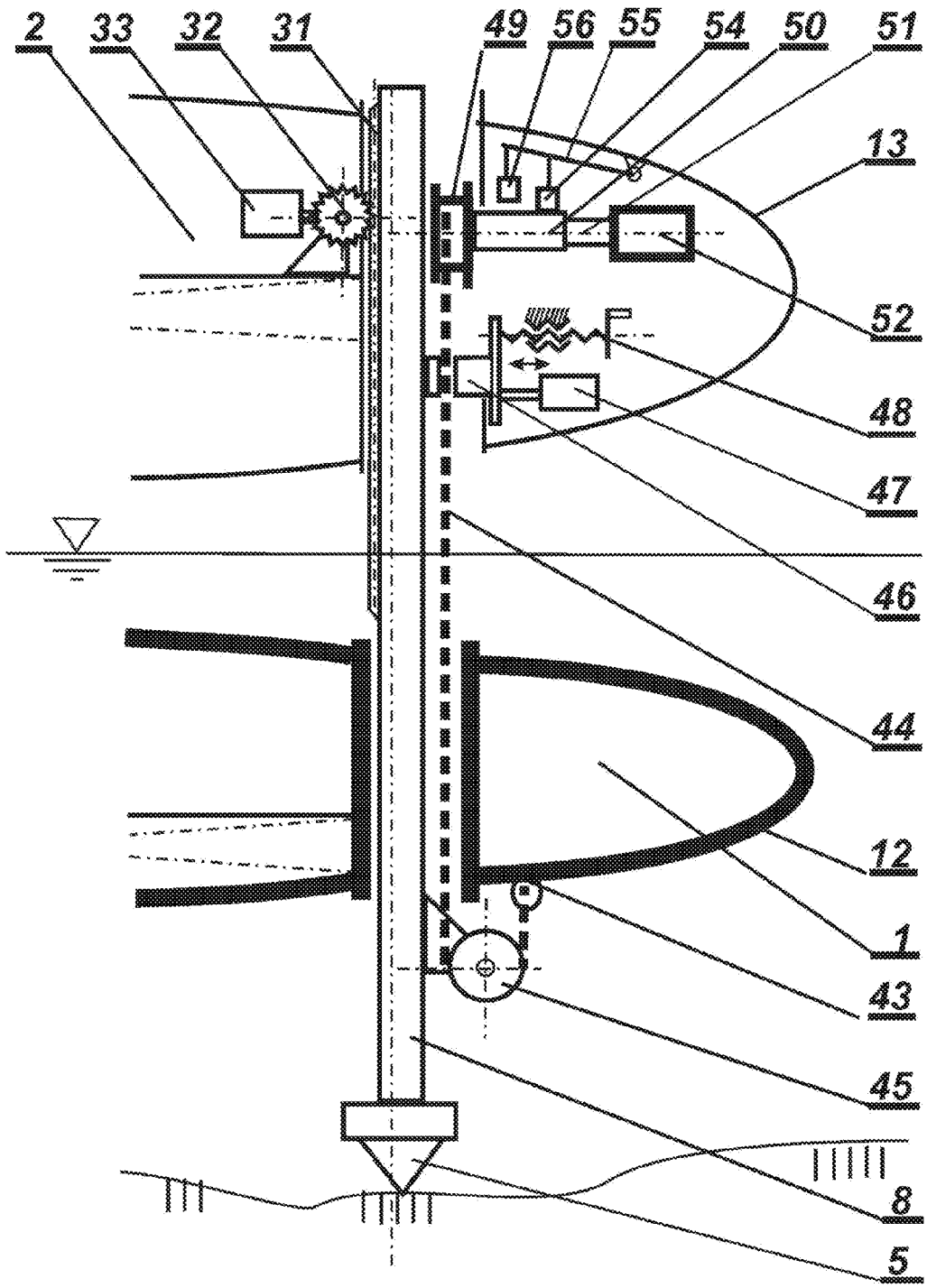
FIG. 6 shows the first embodiment of the mechanism for submerging the underwater accommodation under the water surface to the bottom of the water region.

In the first embodiment of the structure according to FIG. 6, a drive wheel 49 is attached to the structure 13 of the above water accommodation 2 and is connected to a brake drum 50 and driven by a drive unit 52 via a disengaging clutch 51 and there is a chain or a rope 44 wound on the drive wheel 49. The brake drum 50 is in contact with a brake pad 54, which is pressed against the brake drum 50 by a brake pad actuator 56 with the use of an actuator lever 55.

In case of emergency, the underwater accommodation 1 is automatic surfaced after the pressure of the brake pad 54 on the brake drum 50 is released and the jaws of a locking device 46 opened.

Figure 2:
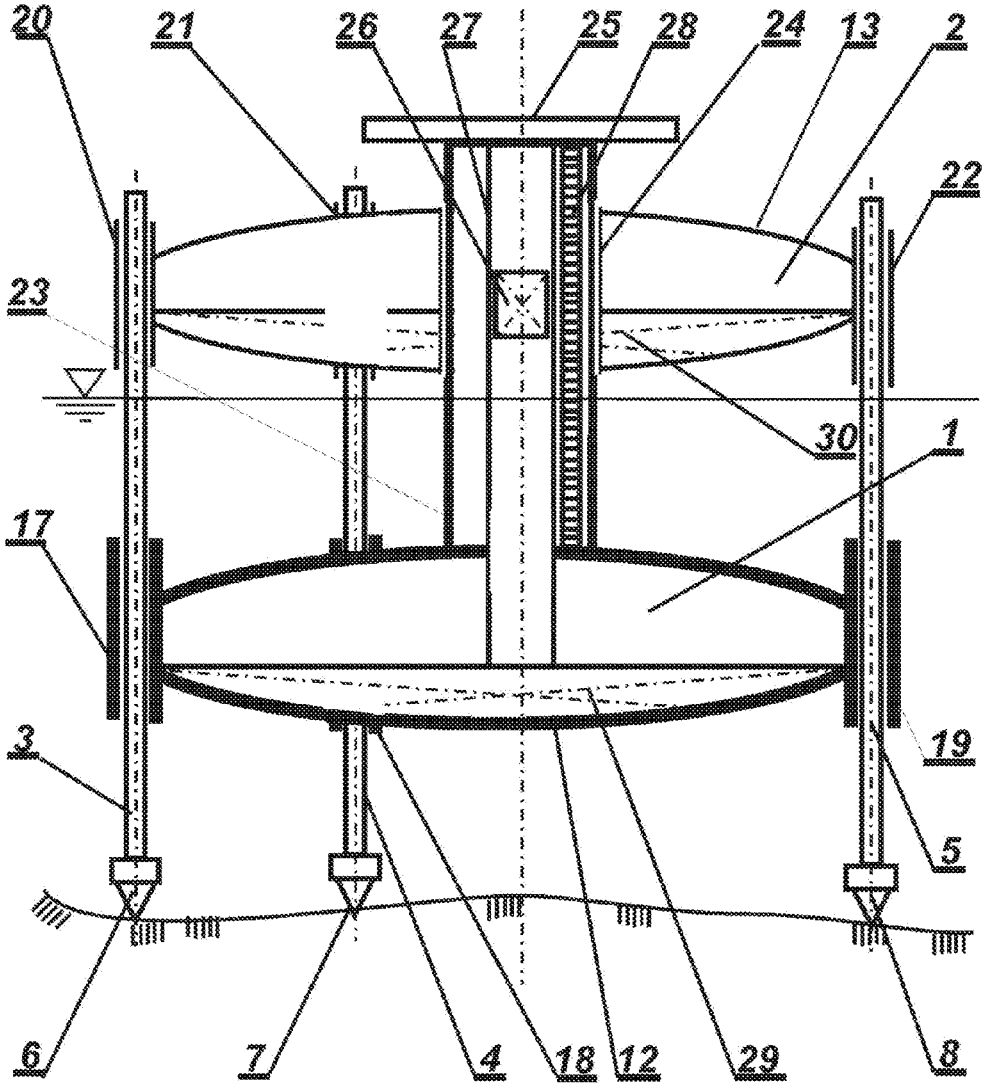
FIG. 2 shows the second embodiment of the attachment of the legs to the structure of the underwater accommodation and to the structure of the above water accommodation.

In the second embodiment shown in FIG. 2, the sliding joint bushings 17,18,19, in which the legs 3,4,5 are located, are attached to the pressure shell 12 of the underwater accommodation 1 on the outside of this shell 12, whereas at the sliding joint of the above water accommodation 2 with vertical legs 3,4,5, the structure 13 of the above water accommodation 2 is fixed to the sliding joint bushings 20,21,22.

Figure 4:
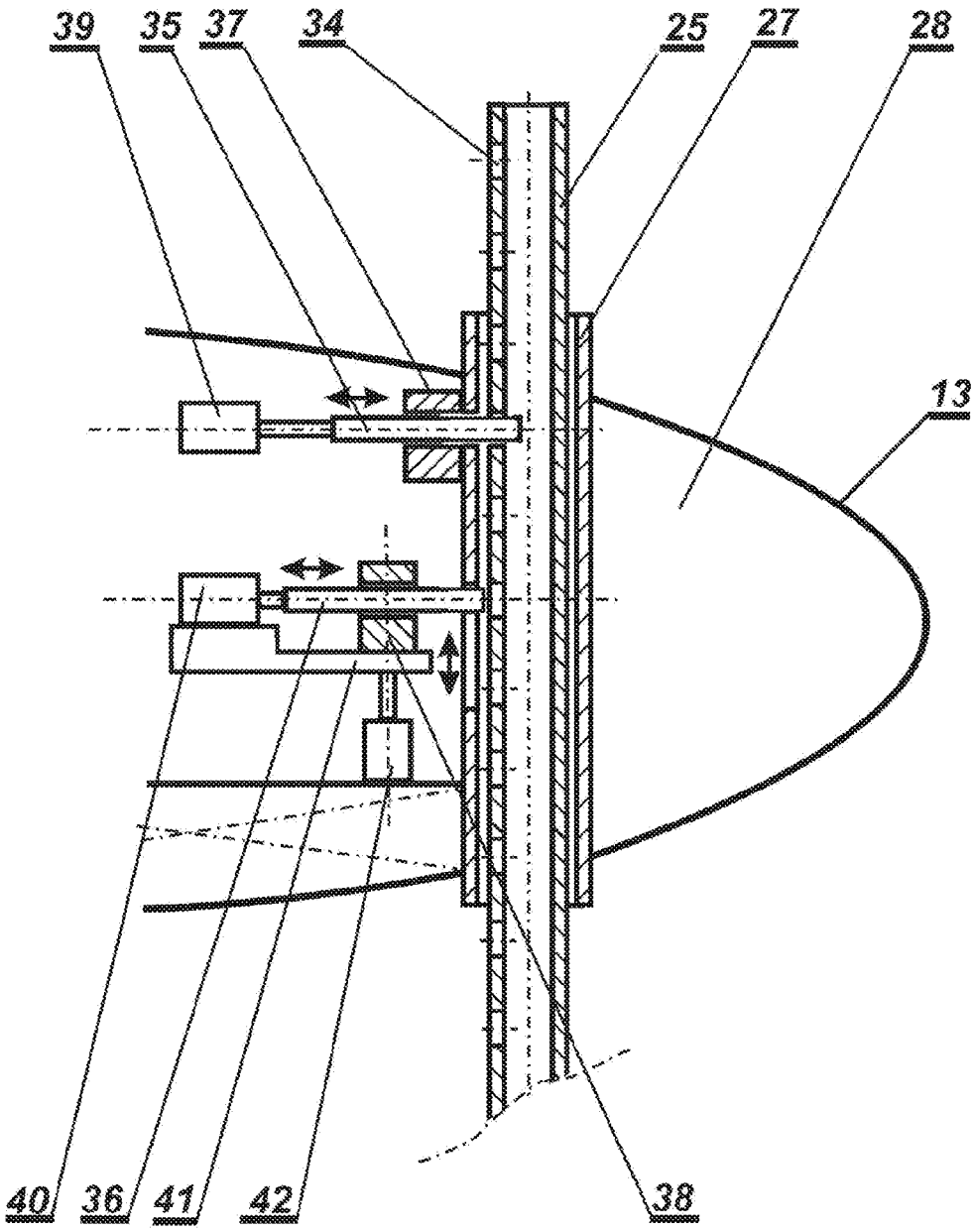
FIG. 4 and FIG. 5 show the second exemplary structure of the assembly for moving the legs with respect to the structure of the above water accommodation.

According to FIG. 4, in the second embodiment of the assembly for moving the legs 3,4,5 with respect to the structure 13 of the above water accommodation 2, each vertical leg 3,4,5 is provided with one vertical row of holes 34, which holes 34 alternately receive pins 35 and 36, mounted slidably in guiding elements 37 and 38 where one kind of the guiding element 37 is movable by a guiding element actuator 39 and together with the guiding element actuator 39, is fixed to the structure 13 of the above water accommodation 2, whereas another kind of the guiding element 38 is movable by a guiding element actuator 40 and, together with the pin 36 and the guiding element actuator 40, is fixed to the base 41 vertically slidable by means of a base actuator 42.

Synchronized, alternating movement of the pins 35 and 36 and the guiding elements 37 and 38 slides the leg 5 with respect to the structure 13 of the above water accommodation 2.

In the position shown in the second embodiment of FIG. 4 the weight of the above water accommodation 2 is transmitted by the pin 35 inserted into one of the holes 34.

Figure 5:
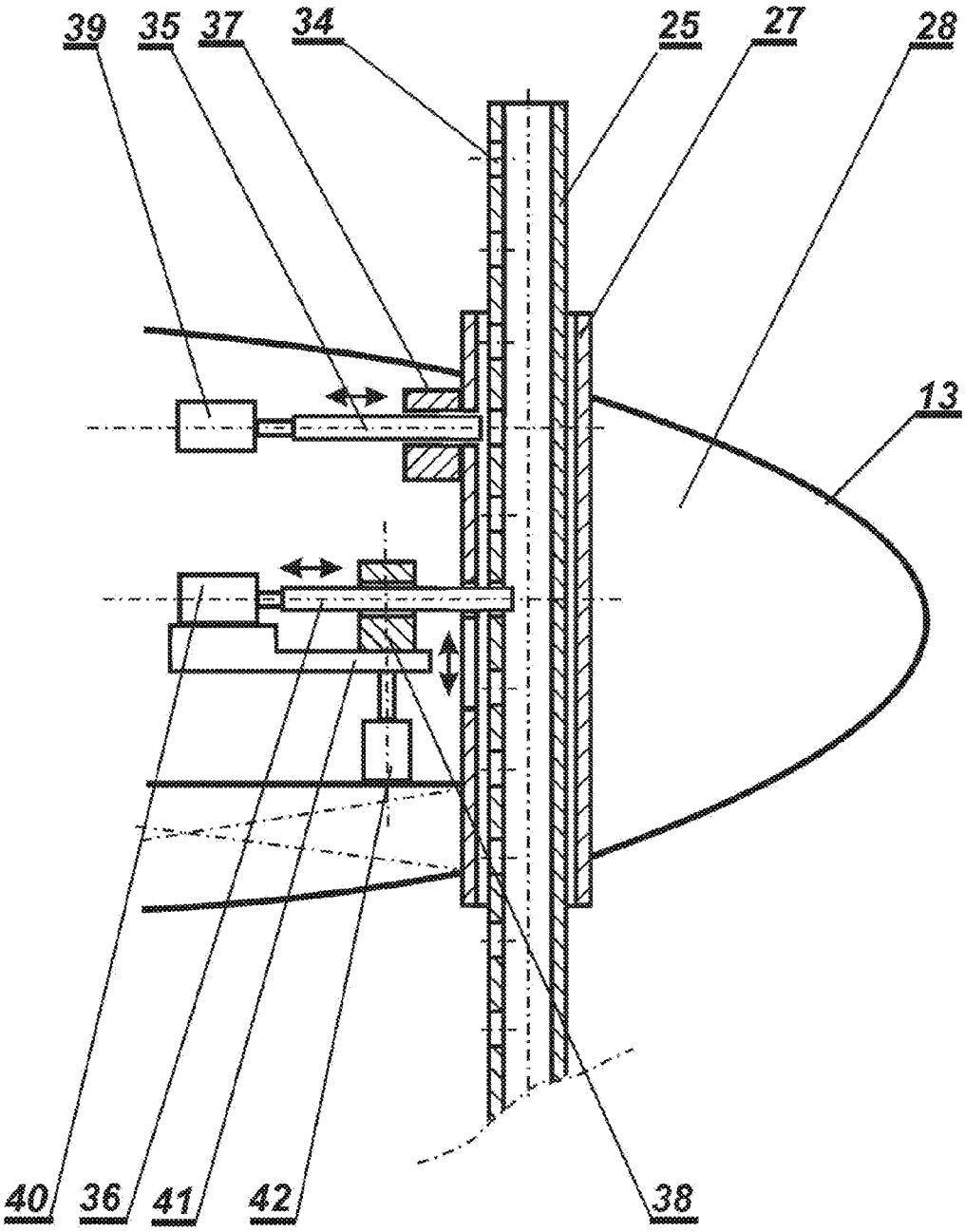

In FIG. 5 the weight of the above water accommodation 2 is transmitted by the pin 36 inserted into the one of the holes 34 and the movement of the pin 36 enforced by the base actuator 42, triggers the movement of the leg 5 with respect to the structure 13 of the above water accommodation 2, and when the leg 5 reaches the proper position in respect of the structure 13 of the above water accommodation 2 the pin 35 is inserted into another hole 34 and the weight of the above water accommodation 2 is transmitted by this pin 35.

To the lower part of the shell 12 of the underwater accommodation 1, there is attached, at each vertical leg 3,4,5 at a certain point 43, a chain or a rope 44 that passes through a roller 45 and the locking device 46 having the jaws clamped with a jaw actuator 47 and a screw 48 with a hand drive. With the use of the chain or the rope 44, the underwater accommodation 1 moves vertically, submerging under the water surface or emerges above the water surface during the normal operation of the underwater-above water accommodation.

Figure 7:
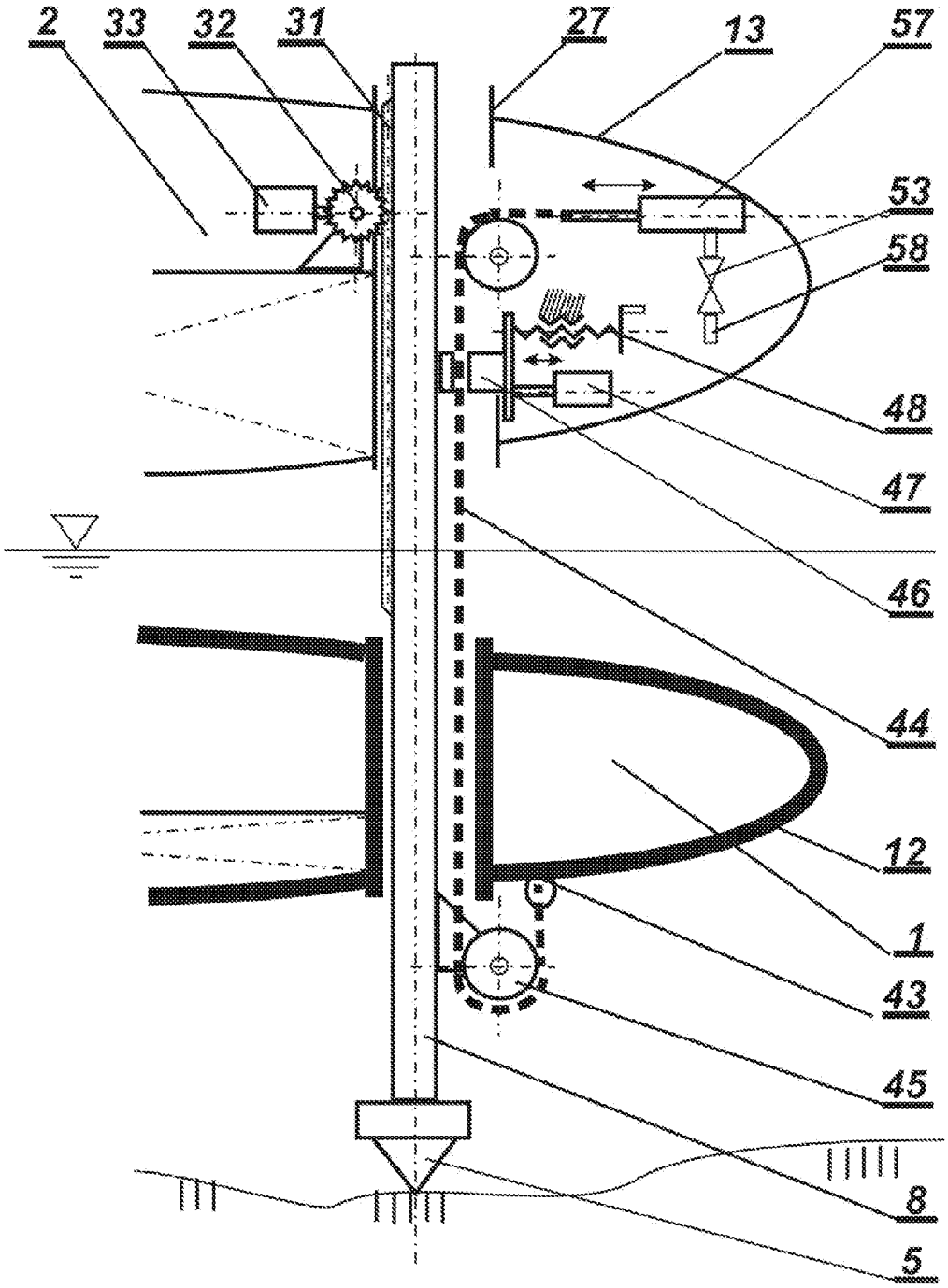
FIG. 7 shows the second embodiment of the mechanism for submerging the underwater accommodation under the water surface to the bottom of the water region.

In the second embodiment according to FIG. 7, the chain or the rope 44, passing through the roller 45 and the locking device 46, is attached to a hydraulic actuator 57 powered by a pipe 58 in which a cut off valve 53 is installed.

In case of emergency, the underwater accommodation 1 is automatic surfaced after the cut off valve 53 and the jaws of the locking device 46 have been opened.

METHOD OF INDUSTRIAL APPLICATION OF THE INVENTION

The underwater-above water accommodation according to the invention is placed on the bottom of the water region. It can be used for rest and recreation purposes in the aquatic environment where the people staying in the underwater accommodation or the above water accommodation can observe this environment. The described above construction of the accommodation ensures safety for the people staying in the underwater accommodation due to its capability of rapid surfacing.

The invention claimed is:

1. An underwater-above water accommodation for residential purposes, adapted for human occupancy in a compartment located under water and in a compartment located above or on the surface of water, comprising an underwater accommodation, an above water accommodation, vertical legs, ballast tanks, a shaft, and a lift, wherein the underwater accommodation and the above water accommodation are slidably joined to vertical legs;

the underwater accommodation is placed under water and at least one vertical shaft is fixed to it;

the at least one vertical shaft contains a lift and stairs and is slidably mounted in the above water accommodation in a sleeve fixed to the above water accommodation;

the underwater accommodation has a pressure shell, in the lower part of which a first ballast tank is located; the above water accommodation has a structure, in the lower part of which a second ballast tank is attached;

at the sliding joint with the vertical legs the underwater accommodation has built-in sliding joint bushings, linked to the pressure shell of the underwater accommodation by a leak-proof joint;

at the sliding joint with vertical legs the structure of the above water accommodation is fixed to the sliding joint bushings, at least one rack is attached to each vertical leg and cooperates with a toothed wheel being fixed to the structure of the above water accommodation and driven by a dive unit;

a drive wheel is attached to the structure of the above water accommodation and it is connected to a brake drum and driven by a drive unit via a disengagable clutch;

a chain or a rope is wound on the drive wheel and the brake drum is in contact with a brake pad, which is pressed against the brake drum by a pad actuator, by means of a actuator lever.

2. The underwater-above water accommodation according to claim 1, wherein the sliding joint bushings, in which the legs are located, are attached to the pressure shell of the underwater accommodation on the outside of the shell, and at the sliding joint of the above water accommodation with vertical legs the structure of the above water accommodation is fixed to the sliding joint bushings.

3. The underwater-above water accommodation, according to claim 1 wherein each vertical leg is provided with at least one vertical row of holes, which holes alternately receive pins, slidably mounted in guiding elements; the guiding element is movable by a guiding element actuator and together with the guiding element actuator is fixed to the structure of the above water accommodation, whereas the other guiding element is movable by a guiding element actuator and together with the pin and the guiding element actuator is fixed to a base, which is slidable vertically by means of a base actuator.

4. The underwater-above water accommodation according to claim 1 which comprises a chain or a rope being attached to the lower part of the shell of the underwater accommodation at each vertical leg at point, wherein the chain or the rope passes through a roller and a locking device which has jaws clamped by a jaw actuator and a screw with a hand drive (48).

5. The underwater-above water accommodation according to claim 1, which comprises a chain or a rope which passes through a roller and a locking device and is attached to a hydraulic actuator powered by a pipe, in which a cut off valve is installed.

6. An underwater-above water accommodation as claimed in claim 1 wherein the underwater accommodation and the above water accommodation are slidably joined to three vertical legs.

* * * * *